US006488323B1

(12) United States Patent
Bouligny

(10) Patent No.: US 6,488,323 B1
(45) Date of Patent: Dec. 3, 2002

(54) APPARATUS FOR GRIPPING OILFIELD TUBULARS WITHOUT CAUSING DAMAGE TO SUCH TUBULARS

(75) Inventor: Vernon Bouligny, New Iberia, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/460,576

(22) Filed: Dec. 14, 1999

Related U.S. Application Data

(63) Continuation of application No. 08/634,184, filed on Apr. 18, 1996, now abandoned.

(51) Int. Cl.[7] ..... B66C 1/46
(52) U.S. Cl. ..... 294/119.3; 269/22
(58) Field of Search ..... 294/63.2, 86.1, 294/86.26, 98.1, 119.3; 29/240; 188/67; 269/22; 279/2.08, 4.03; 285/97; 403/5

(56) References Cited

U.S. PATENT DOCUMENTS

| | | | | | |
|---|---|---|---|---|---|
| 2,992,023 | A | * | 7/1961 | Yantis | 285/97 |
| 3,422,505 | A | * | 1/1969 | Slemmons | 294/119.3 |
| 3,542,354 | A | * | 11/1970 | Fitzpatrick | 294/119.3 X |
| 4,403,801 | A | * | 9/1983 | Huff et al. | 294/119.3 |
| 4,410,210 | A | * | 10/1983 | de Sivry et al. | 294/119.3 |
| 4,687,189 | A | * | 8/1987 | Stoll et al. | 269/22 |
| 4,712,284 | A | * | 12/1987 | Coyle et al. | 269/23 X |
| 4,714,289 | A | * | 12/1987 | Arzenti et al. | 294/119.3 |
| 4,989,909 | A | * | 2/1991 | Bouligny et al. | 294/119.3 |

FOREIGN PATENT DOCUMENTS

| | | | | |
|---|---|---|---|---|
| FR | 2429957 | * | 2/1980 | 285/97 |

* cited by examiner

*Primary Examiner*—Johnny D. Cherry
(74) *Attorney, Agent, or Firm*—The Matthews Firm

(57) ABSTRACT

An apparatus for gripping tubular members in a single or multi-string arrangement about their outer diameter without causing surface damage or structural deformation to the tubular members, so that they may be axially rotated or secured against axial rotation. A generally cylindrical internal sleeve is contained within a molded flexible liner. One side of the internal sleeve is releasably attached to the flexible liner, forming an annular bladder-like structure within the flexible liner. Introduction of pressure into the bladder-like structure causes the flexible liner to inflate radially inward causing the flexible liner and torque transmitting bushing to thereby grip the tubular work piece within the new improved friction grip. Movable anti-extrusion rings at the axial edges of the flexible liner prevent deformation of the liner into the annular space between the outer sleeve of the new improved friction grip and the tubular, and also prevent wear between the axial edges of the liner and the edges of the outer sleeve. An additional, non-rigid sleeve, or coating, of friction enhancing material may be placed on the inner face of the torque transmitting bushing to increase the frictional characteristics of the new improved friction grip and/or increase service life of the surface of the torque transmitting bushing. The new improved friction grip may be made of two, or more, hingedly connected sections, and has a small enough outside diameter to be mounted side-by-side with an identical second grip in a multi-pipe string arrangement without deflecting the pipe.

30 Claims, 3 Drawing Sheets

APPARATUS FOR GRIPPING OILFIELD TUBULARS WITHOUT CAUSING DAMAGE TO SUCH TUBULARS

This application is a continuation of U.S. patent application Ser. No. 08/634,184, filed on Apr. 18, 1996, now abandoned.

BACKGROUND

In well drilling and production operations, equipment for running and retrieving multiple pipe strings is typical. In order to grip the tubulars for the purpose of axially rotating or securing the tubulars against axial rotation, a gripping type device is used. Many of these devices utilize gripping means which cause surface or structural damage to the tubular being gripped. Even minor damage to the surface of the tubular, may result in a premature leak or rupture.

Prior art devices which have reduced the tendency to damage the tubulars being gripped have been relatively complicated in design, and too large for dual string operations. In order to install these devices in a dual string arrangement, the tubulars must be deflected from their normal centerline. This results in damage to the tubular members.

Hitherto, prior art means for gripping tubular members has been by the use of gripping means which result in damage to the surface of the tubular member, or a complicated design which may result in pipe damage when installed in a dual string arrangement. Therefore, the prior art has not disclosed a grip, which does not score or damage the outside diameter of the pipe, nor which may be easily used with an identical second device in a dual string application.

For the foregoing reasons, there is a need for a new improved friction grip for gripping tubular goods by means of frictional engagement only.

For the foregoing reasons, there is a need for a new improved friction grip with a flexible gripping surface to compensate for manufacturing irregularities of tubulars.

For the foregoing reasons there is a need for a new improved friction grip with lowered gripping (radial) forces per unit of contact area.

For the foregoing reasons there is a need for a new improved friction grip which provides a simpler and lower maintenance internal structural design.

For the foregoing reasons, there is a need for a new improved friction grip that can easily be used in a dual string application without damage to or deflection of the tubular member, or which requires modification of traditional torque transfer equipment.

SUMMARY

The new improved friction grip apparatus, for gripping tubular goods, without causing surface or structural damage, is characterized by a generally cylindrical outer sleeve; a flexible liner disposed inside of the outer sleeve; an annular bladder-like structure disposed within the flexible liner; an inner sleeve disposed within the flexible liner; a torque transmitting bushing for the distribution of rotary forces throughout the bladder-like structure; a means for introducing fluid pressure into the bladder-like structure; anti-extrusion rings to prevent deformation of the liner into the annular space between the outer sleeve and tubular member within the new improved friction grip; and, an inner lining or coating of friction enhancing material.

The new improved friction grip is installed around the circumference of the tubular to be gripped, then a controlled amount of fluid pressure is introduced into the bladder-like structure. Initial introduction of pressure causes the flexible liner to expand radially inward and drive the friction sleeve and inner face of the flexible liner into contact with a tubular member.

Further introduction of fluid pressure into the bladder causes the flexible liner and friction sleeve to thrust against the tubular with increased radial pressure. By controlling the amount of fluid pressure introduced into the bladder the lowest amount of radial force necessary to produce adequate torquing (frictional force) can be selected.

Once the new improved friction grip has been engaged with fluid pressure, rotary torque is applied to the outer sleeve by various conventional means (tongs, pipe wrenches, etc.). The torque applied to the outer sleeve is transmitted through the outer sleeve, torque transmitting bushing, and flexible liner to the gripped pipe.

When the tubular work piece has been sufficiently tightened, external torque is removed from the new improved friction grip and fluid pressure in the bladder-like structure released. Upon release of the fluid pressure the flexible liner elastically retracts from contact with the work piece and the new improved friction grip is removed. The new improved friction grip may be made in two (or more) hingedly connected sections to facilitate installation on, or removal from, tubular goods.

DESCRIPTION

The preferred embodiment of the new improved friction grip, 20, has eight components, those being; a rigid, generally cylindrical outer sleeve, 1; a flexible liner, 2, securely attached to the radially inward face, 11, of the outer sleeve, 1; means for introduction and withdrawal of fluid pressure, 3, into a bladder-like structure, 4, disposed within the flexible liner; an inner sleeve, 5, disposed within the flexible liner, 2, and adjacent to the bladder-like structure, 4; two, generally annular, anti-extrusion rings, 6, to prevent deformation of the flexible liner into the space between the outer housing and a tubular member; a flexible conformable torque transmitting bushing, 7; and, an inner friction sleeve or coating, 8, attached to the radially inward face of the torque transmitting bushing, 7.

Figure 1:
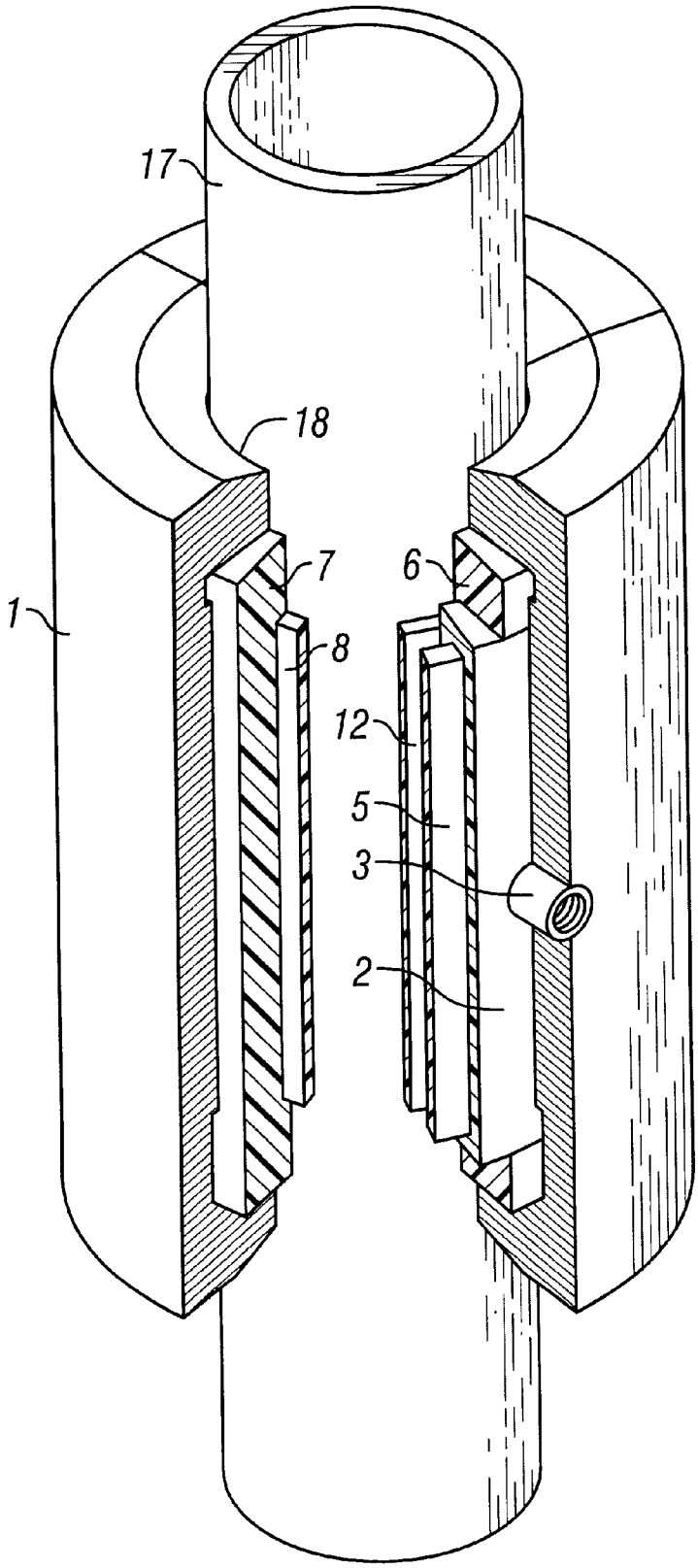
FIG. 1 is a schematical isometric partial sectional view of the new improved friction grip.
Figure 2:
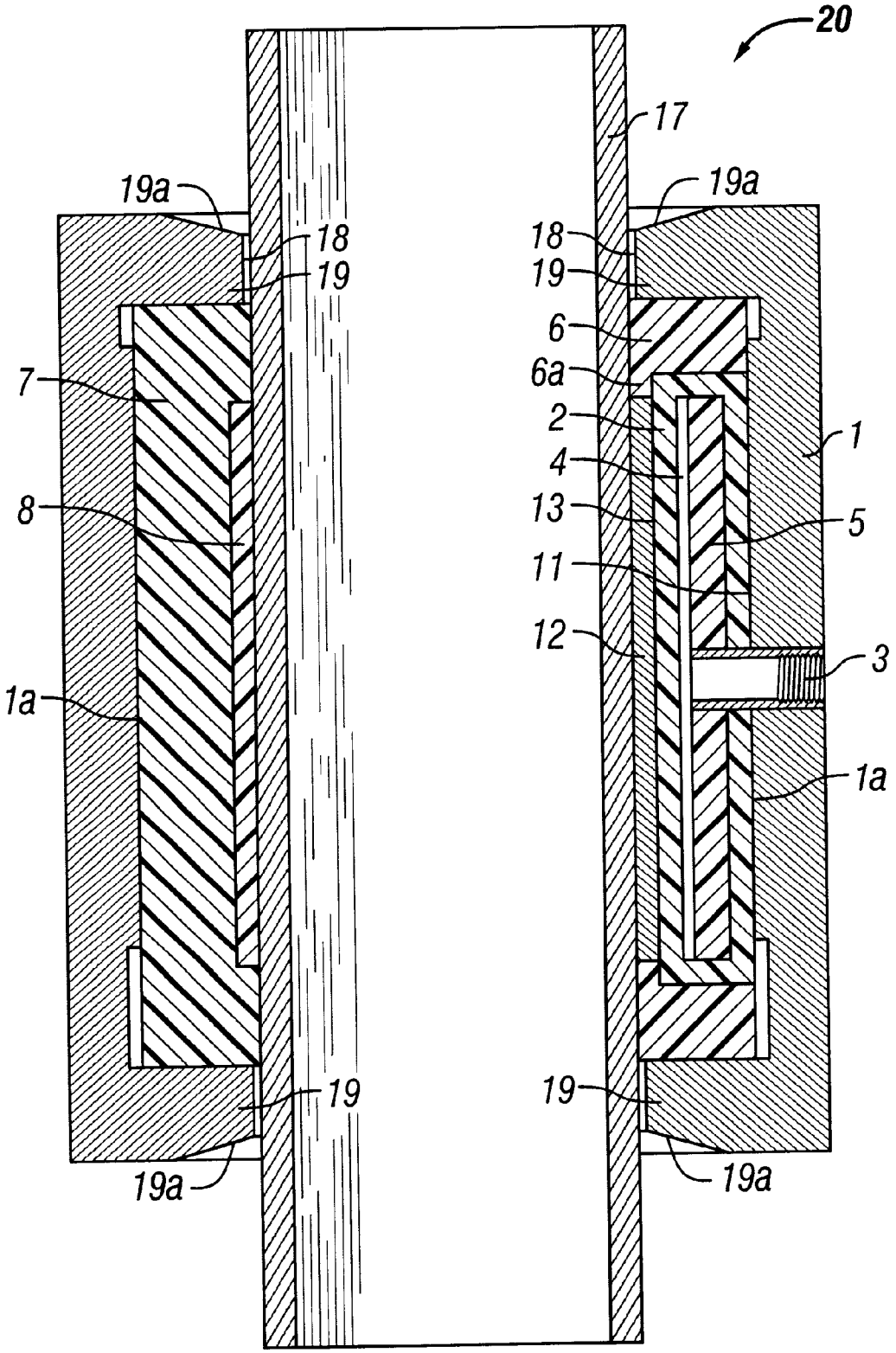
FIG. 2 is a schematical cross-sectional view of the new improved friction grip from overhead.
Figure 3:
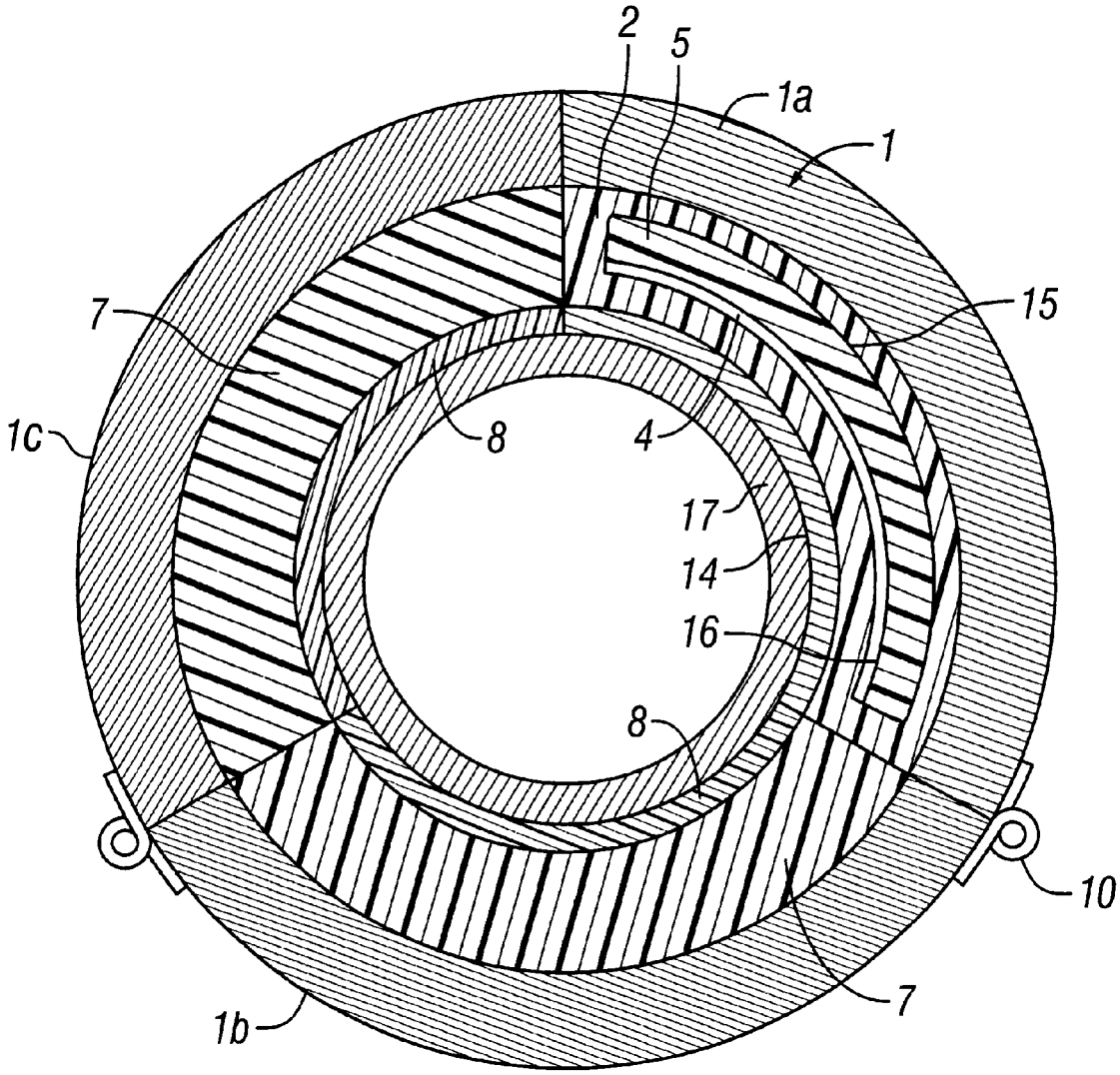
FIG. 3 is a schematical longitudinal cross-section of the new improved friction grip.

With reference to FIG. 1, FIG. 2, and FIG. 3, the first major component of the new improved friction grip, 20, is the rigid outer sleeve, 1. The outer sleeve 1, is generally cylindrical with a central axial bore slightly larger than the outer diameter of tubular members to be gripped. An annular cavity, 1*a*, extends radially outward from the central bore, which is of sufficient depth to accommodate a flexible liner, 2, bushing insert, 12, torque transmitting busing, 7, and inner friction sleeve, 8. The outer sleeve, 1, further includes retaining lips, 19, disposed at the axial extremes of the outer sleeve, 1, which extend radially inward to generally prevent deformation of the torque transmitting bushing, 7, and anti-extrusion rings, 6, into the annular space, 18. The exterior surface, 19*a*, of the retaining lip, 19, is tapered to facilitate the insertion and removal of the new improved friction grip, 20, from the tubular member, 17. In the preferred embodiment, the outer sleeve is comprised of three cylindrical sections, 1*b*, 1*c*, and 1*d*, connected by hinge, 10, to facilitate placement around and removal from tubular members. However, the new improved friction grip may be made of an integral cylinder, or any convenient plurality of hingedly connected cylindrical sections comprising a complete cylinder.

With further reference to FIG. 1, FIG. 2, and FIG. 3, the second major component of the new improved friction grip, 20, is the flexible liner, 2. The flexible liner, 2, is securely attached to no more than one-half of the radially inward face, 11, of the outer sleeve, 1. Unlike other prior art devices, it is not necessary for the flexible liner, 2, to span the entire radially inner face, 11, of the outer sleeve, 1, in order to deliver the required gripping force. In the preferred embodiment the flexible liner 2, spans approximately one-third of the radially inner face, 11, of the outer sleeve, 1. I have found that the ability to provide the necessary gripping force is not increased significantly when the flexible liner, 2, spans an area greater than one-half. The flexible liner, 2, is made of durable, elastic material which is somewhat flexible, yet resilient to compressive and shear forces. I have found certain pourable high density polyurethane compounds which work well, but a wide variety of other suitable materials could also be used. The liner material may be reinforced with suitable fibers for increased service life. For devices designed to grip smaller diameter tube, e.g., 2⅞", a busing insert, 12, of suitable material and thickness is securely attached to the radially inward face, 13, of the flexible Liner. The bushing insert is necessary to fill the void created between the flexible liner and the smaller tube diameter to be gripped to ensure complete contact. The busing insert is capable of transmitting the torque from the flexible liner to the tube. In the preferred embodiment, the bushing insert, 12, is made of a polyurethane material of suitable density.

Further, referring to FIG. 1, FIG. 2 and FIG. 3, the third major component of the new improved friction grip, 20, is the inner sleeve, 5. The inner sleeve, 5, is generally cylindrical in shape, and is disposed within the flexible liner, 2, adjacent to the bladder-like structure, 4. In the preferred embodiment the radially outward face, 15, of the inner sleeve, 5, is securely attached to the flexible liner, 2, whereas the radially inward face, 16, of the inner sleeve, 5, is releasable from the flexible liner, 2. In practice I accomplish this by using material for the flexible liner, 2, which is pourable before curing. The radially inward face of the inner sleeve, 5, is coated with a suitable releasing agent before pouring the flexible liner, 2, around it. Therefore after curing of the flexible liner, 2, the radially inward face of the inner sleeve, 5, remains unattached to the liner. By leaving one face of the inner sleeve, 5, not attached to the flexible liner, 2, an annular, inflatable, bladder-like structure, 4, is formed on one side of the inner sleeve, 5.

The next component of the new improved friction grip, 20, is a means for introduction and withdrawal of fluid pressure into the bladder-like structure, 4. In the preferred embodiment this is accomplished by means of a tube, 3, which sealingly penetrates the outer sleeve 1, the flexible liner, 2, and the inner sleeve, 5. When pressure, usually hydraulic, is introduced into the bladder-like structure, 4, through tube, 3, said pressure causes the bladder-like structure, 4, to expand. Since outward expansion of the liner is prevented by the rigid outer sleeve, 1, the flexible liner, 2, deforms radially inward, pushing the radially inward face, 14, of the flexible liner, 2, into contact with a 10 tubular member, 17, within the device. By controlling the amount of fluid pressure within the bladder-like structure, 4, the flexible liner, 2, and therefore the torque transmitting bushing, 7, can be forced against the tubular member, 17, with any desired amount of radial force (which is generally proportional to the torque which the device can transfer).

The next component of the new improved grip, 20, is anti-extrusion rings, 6. In the preferred embodiment annular anti-extrusion rings, 6, are disposed at the axial extremes of the flexible liner, 2, to prevent deformation of the flexible liner, 2, into the annular space, 18, during inflation of the bladder-like structure, 4. I have found that such deformation, if allowed, tends to reduce the service life of the flexible liner, 2. In the preferred embodiment the anti-extrusion rings, 6, are made of a rigid material which has a characteristically low coefficient of friction, such as plastic or a composite. A further advantage of using the anti-extrusion rings, 6, is the prevention of wear between the flexible liner, 2, and outer sleeve 1. As the flexible liner, 2, deforms radially inward in response to hydraulic pressure, the anti-extrusion rings, 6, also slide radially inward, against the outer sleeve, 1, thereby preventing frictional wear between the flexible liner, 2, and the outer sleeve, 1. The anti-extrusion rings, 6, have a small lip, 6*a,* projecting slightly over the radially inward face of the flexible liner, 2, to assure movement with, rather than against, the flexible liner, 2.

With reference to FIG. 1, FIG. 2, and FIG. 3, the next component of the new improved friction grip, 20, is the torque transmitting bushing, 7. The torque transmitting bushing, 7, is securely attached to at least one-half of the radially inward face, 11, of the outer sleeve, 1. The torque transmitting bushing is made of a rigid but conformable polyurethane material. When the flexible liner, 2, deforms radially inward in response to hydraulic pressure, the torque transmitting bushing, 7, is then forced into conformable engagement with the pipe, 17. When torque is applied to the outer sleeve, 1, the torquing force is transmitted from the outer sleeve, 1, through the torque transmitting bushing, 7, and flexible liner, 2, to the pipe, 17, being gripped.

With reference to FIG. 1, FIG. 2 and FIG. 3 the last major component of the new improved friction grip is an optional inner friction sleeve (or coating), 8. The friction sleeve (or coating), 8, is made of a highly durable and flexible material having a characteristically high coefficient of friction. I have found that a thin sleeve of commercially available, metal reinforced, fiberglass based brake material works well, but numerous other materials could be used. The friction sleeve (or coating), 8, is attached to the radially inward face of the torque transmitting bushing, 7, and is therefore disposed between the torque transmitting bushing, 7, and a tubular member 17, to be gripped. The friction sleeve (or coating), 8, is used to increase the coefficient of friction between the gripping surface of the invention and the tubular member, 17, when the inherent frictional characteristics of the torque transmitting bushing material is insufficient to generate adequate torque at acceptable radial pressure, or simply to increase service life of the torque transmitting bushing, 7. I have found it preferable to attach the friction sleeve, 8, in such a manner that it is easily removable, so that the sleeve alone may be replaced when worn.

The new improved friction grip is simple and easy to use. It may be applied on the tubular member as a separate apparatus and then conventional driving (or securing) devices such as wrenches or tongs maybe used to rotate (or secure) the outer housing. Alternatively, the new improved friction grip may be integrally installed on a conventional driving (or securing) device such as a wrench or tongs used to rotate (or secure) the outer housing. Alternatively, the new improved friction grip may be integrally installed on a conventional driving (or securing) device, such as tongs for automatic use therewith. The aforementioned installations may be easily accomplished with conventional equipment, in a single or multi-string application without the need to deflect the pipe being gripped.

To activate the new improved friction grip, fluid pressure is applied into the bladder-like structure, 4. The flexible liner, 2, deforms radially inward until it and the torque transmitting bushing, 7, contact the tubular, 17. Further increasing the pressure within the bladder causes increasing radially inward force ("grip") to be applied to the tubular, 17. Once the bladder is inflated to the desired pressure, said pressure is maintained either by continuous pressure supply or by use of a valve to retain the pressure within. Generally the lowest fluid pressure is applied which is required to produce that amount of gripping force which is necessary to prevent the new improved friction grip from slipping when the desired torque is applied to the pipe. The fluid pressure required to produce a certain torque is roughly proportional to the radial thrust applied to the tubular. Due to the large contact area between the new improved friction grip and the tubular, and the uniformity with which radial pressure is applied around the tubular's entire circumference, reduced radial forces per unit of contact area are capable of generating large frictional forces (rotary torque) without risk of radial collapse or risk of surface damage to the tubular. If necessary, the new improved friction grip may be extended axially, as desired, to distribute the radial-compression forces required to generate a particular torque over an even larger area. It is, therefore, possible with this invention to avoid excessive clamping (radially inward) pressures that could cause surface or structural damage to tubular members, even with soft pipes or their coatings. Various other uses and modifications of the present invention will occur to those skilled in the art. For example, the new improved friction grip could easily be used as a coupling for rotary drive shafts. By way of further example the new improved friction grip could be modified to operate as a hydraulic brake for shafts, wheels, cylinders or almost any cylindrical shaped object.

Accordingly, this patent is intended to embrace all such alternatives, modifications, and variations as falling with the spirit of the invention and scope of the appended claims.

What is claimed is:

1. A friction grip apparatus, for gripping a cylindrical member about its external diameter without causing surface or structural damage to said cylindrical member, for use in conjunction with means to axially rotate said cylindrical member, or secure said member against rotation, comprising:

a. a rigid, generally cylindrical outer sleeve having an axial bore slightly larger than the external diameter of the cylindrical member to be gripped, and having a somewhat larger annular shaped central cavity therein;

b. an elastic flexible liner securely attached to no more than one-half of the radially inward face of the annular shaped cavity of the outer sleeve;

c. an inner sleeve, disposed within said flexible liner, said inner sleeve having one side securely attached to said flexible liner, and its opposite side forming an internal annular bladder between said inner sleeve and said flexible liner by being releasable from the flexible liner, such that said flexible liner may move radially inward in response to fluid pressure between said inner sleeve and said flexible liner;

d. a torque transmitting bushing, securely attached to at least one-half of the radially inward face of the annular shaped cavity of the outer sleeve; and, e. means for introduction of or withdrawal of a desired amount of fluid pressure into or from the annular bladder, so as to cause a desired amount of radially inward force to act on said cylindrical member within said friction grip apparatus.

2. The apparatus of claim 1, further comprising:

a generally cylindrical friction sleeve made of durable, non-rigid material with a characteristically high coefficient of friction, wherein said friction sleeve is disposed on the radially inward face of said torque transmitting bushing.

3. The apparatus of claim 2, further comprising: generally annular anti-extrusion rings, made of a rigid low coefficient of friction material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner.

4. The apparatus of claim 3, wherein said outer sleeve, flexible liner, anti-extrusion rings, and torque transmitting bushing are comprised of a plurality of hingedly connected axial sections of a cylinder consisting of a whole cylinder, wherein the flexible liner and anti-extrusion rings are disposed within at least one cylindrical section, said cylindrical section being provided with said means for introduction or withdrawal of a desired amount of fluid pressure into or from the bladder-like structure formed therein.

5. The apparatus of claim 3, wherein said anti-extrusion rings are comprised of a plastic material.

6. The apparatus of claim 2, wherein said outer sleeve, flexible liner, torque transmitting bushing, and friction sleeve are comprised of a plurality of hingedly connected axial sections of a cylinder consisting of a whole cylinder, wherein the flexible liner is disposed within at least one cylindrical section, said cylindrical section being provided with said means for introduction or withdrawal of a desired amount of fluid pressure into or from the bladder-like structure formed therein.

7. The apparatus of claim 6, wherein said friction sleeve is comprised of metal reinforced fiberglass based material.

8. The apparatus of claim 2, wherein said friction sleeve is comprised of metal reinforced fiberglass based braking material.

9. The apparatus of claim 1, further comprising: generally annular anti-extrusion rings, made of a rigid low coefficient of friction material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner.

10. The apparatus of claim 9, wherein said outer sleeve, flexible liner, anti-extrusion rings, and torque transmitting bushing are comprised of a plurality of hingedly connected axial sections of a cylinder consisting of a whole cylinder, wherein the flexible liner and anti-extrusion rings are disposed within at least one cylindrical section, said cylindrical section being provided with said means for introduction or withdrawal of a desired amount of fluid pressure into or from the bladder-like structure formed therein.

11. The apparatus of claim 9, wherein said anti-extrusion rings are comprised of a plastic material.

12. The apparatus of claim 1, wherein said outer sleeve, flexible liner, and torque transmitting bushing, are comprised of a plurality of hingedly connected axial sections of a cylinder comprising a complete cylinder, wherein the flexible liner is disposed within at least one cylindrical section, said cylindrical section being provided with said means for introduction or withdrawal of a desired amount of fluid pressure into or from the bladder-like structure formed therein.

13. The apparatus of claim 12, wherein said flexible liner is comprised of a pourable high density polyurethane material.

14. The apparatus of claim 1, wherein said flexible liner is comprised of a pourable high density polyurethane material.

15. The apparatus of claim 1, wherein said means for introduction of a desired amount of fluid pressure into said annular bladder is comprised of a tube which sealingly penetrates and extends through the radially outward face of said outer sleeve to the radially inward face of said inner sleeve.

16. A friction grip apparatus, for gripping a cylindrical member about its external diameter without causing surface or structural damage to said cylindrical member, for use in conjunction with means to axially rotate said cylindrical member, or secure said member against rotation, comprising:

a. a rigid, generally cylindrical outer sleeve having an axial bore slightly larger than the external diameter of the cylindrical member to be gripped, and having a somewhat larger annular shaped central cavity and therein;

b. an elastic flexible liner securely attached to no more than one-half of the radially inward face of the annular shaped cavity of the outer sleeve;

c. an inner sleeve, disposed within said flexible liner, said inner sleeve having one side securely attached to said flexible liner, and its opposite side forming an internal annular bladder by being releasable from the flexible liner, such that said flexible liner may move radially inward in response to fluid pressure between said inner sleeve and said flexible liner;

d. a generally cylindrical bushing insert, made of a durable, semi-rigid polyurethane material, which said insert bushing is disposed on the radially inward face of said flexible liner;

e. a torque transmitting bushing, securely attached to at least one-half of the radially inward face of the annular shaped cavity of the outer sleeve; and f. means for introduction of or withdrawal of a desired amount of fluid pressure into or from the annular bladder, so as to cause a desired amount of radially inward force to act on the external diameter of the cylindrical member.

17. The apparatus of claim 16, further comprising: generally annular anti-extrusion rings, made of a rigid low coefficient of friction material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner.

18. The apparatus of claim 17, wherein said outer sleeve, flexible liner, anti-extrusion rings, bushing insert, and torque transmitting bushing are comprised of a plurality of hingedly connected axial sections of a cylinder consisting of a whole cylinder, wherein the flexible liner and anti-extrusion rings are disposed together within at least one cylindrical section, said cylindrical section being provided with said means for introduction or withdrawal of a desired amount of fluid pressure into or from the bladder-like structure formed therein.

19. The apparatus of claim 17, wherein said anti-extrusion rings are comprised of a plastic material.

20. The apparatus of claim 16, wherein said outer sleeve, flexible liner, and torque transmitting bushing, are comprised of a plurality of hingedly connected axial sections of a cylinder comprising a complete cylinder, wherein the flexible liner and bushing insert are disposed together within at least one cylindrical section, said cylindrical section being provided with said means for introduction or withdrawal of a desired amount of fluid pressure into or from the bladder-like structure formed therein.

21. The apparatus of claim 20, wherein said flexible liner is comprised of a pourable high density polyurethane material.

22. The apparatus of claim 16, wherein said flexible liner is comprised of a pourable high density polyurethane material.

23. The apparatus of claim 16, wherein said means for introduction of a desired amount of fluid pressure into said annular bladder is comprised of a tube which sealingly penetrates and extends through the radially outward face of said outer sleeve to the radially inward face of said inner sleeve.

24. The apparatus of claim 16, further comprising:

a generally cylindrical friction sleeve made of durable, non-rigid material with a characteristically high coefficient of friction, wherein said friction sleeve is disposed on the radially inward face of said torque transmitting bushing.

25. The apparatus of claim 24, further comprising:

generally annular anti-extrusion rings, made of a rigid low coefficient of friction material, said anti-extrusion rings being slidably disposed between the axially outward edge of the flexible liner and the axially inward edge of the annular cavity within the outer sleeve, and said anti-extrusion rings further having a radial lip which extends over a minority of the radially inward face of the flexible liner.

26. The apparatus of claim 25, wherein said outer sleeve, flexible liner, bushing insert, anti-extrusion rings, and torque transmitting bushing are comprised of a plurality of hingedly connected axial sections of a cylinder consisting of a whole cylinder, wherein the flexible liner, bushing insert, and anti-extrusion rings are disposed together within at least one cylindrical section, said cylindrical section being provided with said means for introduction or withdrawal of a desired amount of fluid pressure into or from the bladder-like structure formed therein.

27. The apparatus of claim 25, wherein said anti-extrusion rings are comprised of aplastic material.

28. The apparatus of claim 24, wherein said outer sleeve, flexible liner, bushing insert, torque transmitting bushing, and friction sleeve are comprised of a plurality of hingedly connected axial sections of a cylinder consisting of a whole cylinder, wherein the flexible liner and bushing insert are disposed together within at least one cylindrical section, said cylindrical section being provided with said means for introduction or withdrawal of a desired amount of fluid pressure into or from the bladder-like structure formed therein.

29. The apparatus of claim 28, wherein said friction sleeve is comprised of metal reinforced fiberglass braking material.

30. The apparatus of claim 24, wherein said friction sleeve is comprised of metal reinforced fiberglass based brake material.

* * * * *